US012188325B2

(12) United States Patent
Lachance et al.

(10) Patent No.: US 12,188,325 B2
(45) Date of Patent: Jan. 7, 2025

(54) APPARATUSES AND METHODS FOR USE WITH REVERSE CIRCULATION OVERSHOT SYSTEMS

(71) Applicant: BLY IP INC., Salt Lake City, UT (US)

(72) Inventors: Anthony Lachance, Burlington (CA); Andres MacLoughlin, Grange (AU)

(73) Assignee: Boart Longyear Company, Salt Lake City, UT (US)

( * ) Notice: Subject to any disclaimer, the term of this patent is extended or adjusted under 35 U.S.C. 154(b) by 0 days.

(21) Appl. No.: 18/033,977

(22) PCT Filed: Oct. 27, 2021

(86) PCT No.: PCT/US2021/056845
§ 371 (c)(1),
(2) Date: Apr. 26, 2023

(87) PCT Pub. No.: WO2022/093954
PCT Pub. Date: May 5, 2022

(65) Prior Publication Data

US 2023/0399916 A1 Dec. 14, 2023

Related U.S. Application Data

(60) Provisional application No. 63/235,437, filed on Aug. 20, 2021, provisional application No. 63/106,677, filed on Oct. 28, 2020.

(51) Int. Cl.

| | |
|---|---|
| ***E21B 33/12*** | (2006.01) |
| ***E21B 25/02*** | (2006.01) |
| ***E21B 34/10*** | (2006.01) |
| ***E21B 47/06*** | (2012.01) |

(52) U.S. Cl.
CPC ..... *E21B 33/12* (2013.01); *E21B 25/02* (2013.01); *E21B 34/10* (2013.01); *E21B 47/06* (2013.01); *E21B 2200/04* (2020.05)

(58) Field of Classification Search
CPC ..... E21B 25/02; E21B 33/12; E21B 34/10; E21B 34/142; E21B 47/06; E21B 2200/04; E21B 17/04; E21B 31/18
See application file for complete search history.

(56) References Cited

U.S. PATENT DOCUMENTS

| | | | | |
|---|---|---|---|---|
| 8,051,924 | B2 | 11/2011 | Drenth | |
| 2010/0206580 | A1* | 8/2010 | Tessari | E21B 23/10 166/77.51 |
| 2020/0003021 | A1 | 1/2020 | Drenth | |

FOREIGN PATENT DOCUMENTS

| | | | | |
|---|---|---|---|---|
| WO | WO-2018152089 | A1 * | 8/2018 | E21B 23/08 |
| WO | WO-2020205461 | A1 * | 10/2020 | E21B 10/26 |
| WO | 2022093954 | | 12/2023 | |

* cited by examiner

*Primary Examiner* — George S Gray
(74) *Attorney, Agent, or Firm* — Ballard Spahr LLP

(57) ABSTRACT

A system can comprise a drill string sub that is configured to couple to a drill rod of a drill string, wherein the drill string sub defines a shoulder and at least one through hole. A plug assembly can be receivable with a bore of the drill. The plug assembly can be releasably coupled to the drill string sub. When decoupled from the drill string, the plug assembly can be configured to be pumped into the drill string. The plug assembly can comprise a distal subassembly that defines a receiver that is configured engage a reverse circulation overshot. A proximal subassembly can be coupled to the distal subassembly. The proximal subassembly can comprise a brake apparatus that is configured to inhibit proximal movement of the plug assembly.

18 Claims, 12 Drawing Sheets

APPARATUSES AND METHODS FOR USE WITH REVERSE CIRCULATION OVERSHOT SYSTEMS

CROSS-REFERENCE TO RELATED APPLICATIONS

This application is a national phase filing under 35 U.S.C. § 371 of International Application No. PCT/US2021/056845, filed Oct. 27, 2021, which claims priority to and the benefit of the filing date of U.S. Provisional Patent Application No. 63/106,677, filed Oct. 28, 2020 and 63/235,437, filed Aug. 20, 2021. Each of these applications is incorporated herein by reference in its entirety.

FIELD

The disclosed invention relates to drilling systems and methods for reverse circulation overshot systems.

BACKGROUND

In core sampling operations, instead of using a wireline, a reverse circulation overshot can be pumped distally down a drill string where the overshot can couple to a head assembly (i.e., a core barrel head assembly) having a core sample therein. Then, using a method known as reverse circulation, fluid can be pumped distally down a borehole until the fluid reaches the bottom of the borehole and reverses direction to apply a proximal force on the reverse overshot to retrieve the core sample. Once the overshot reaches a proximal end of the drill string, the overshot can couple to an overshot catcher. Conventionally, an operator has no feedback indicating that the overshot has coupled to the overshot catcher.

Further, in certain circumstances, the coupled pair of the overshot and head assembly can get stuck at an unknown location along the drill string. To recover the stuck pair, drill rods can be sequentially removed from the drill string. This requires removal of a sub at the proximal end of the drill string that inhibits the coupled pair from coming out of the drill string. However, for up-hole drilling, a large mass of fluid can be held above (distal of) the stuck coupled pair of the overshot and head assembly. Thus, if the coupled pair is dislodged from its stuck position in the drill string, the mass of fluid and the coupled pair (the overshot and head assembly) can be undesirably released from the drill string, posing a potential safety hazard.

SUMMARY

Described herein, in various aspects, is a system having a longitudinal axis, the system comprising a drill string sub that is configured to couple to a drill rod of a drill string. The drill string sub can comprise an outer surface, an inner surface defining an inner bore, and at least one through-hole extending between the outer surface and the inner surface. The drill string sub can define a shoulder. A plug assembly can be receivable within the bore of the drill string sub. The plug assembly can comprise a proximal subassembly that is configured to engage the shoulder of the drill string sub so that the shoulder restricts proximal axial movement of the proximal subassembly. A distal subassembly can be slidably coupled to the proximal subassembly relative to the longitudinal axis. The distal subassembly can comprise a seal that is configured to bias against the inner surface of the drill string sub to inhibit fluid travel between the distal subassembly and the inner surface of the drill string sub. A biasing element can be configured to bias the distal subassembly distally to a first position. In the first position, the seal of the distal subassembly can be distal of the at least one through-hole of the drill string sub by a first distance. In response to a distal force that surpasses a threshold proximal force provided by the biasing element, the distal subassembly can be configured to travel proximally until the seal of the distal subassembly is proximal of the at least one through-hole of the drill string sub.

In another aspect, a system having a longitudinal axis can comprise a drill string sub that is configured to couple to a drill rod of a drill string having an inner surface. The drill string sub can comprise an outer surface and an inner surface defining an inner bore. A plug assembly can be received within the inner bore of the drill string sub and releasably coupled to the drill string sub. When decoupled from the drill string, the plug assembly can be configured to be pumped into the drill string. The plug assembly can comprise a distal subassembly that defines a receiver that is configured engage a reverse circulation overshot. A proximal subassembly can be coupled to the distal subassembly. The proximal subassembly can comprise a brake apparatus that is configured to inhibit proximal movement of the plug assembly.

In some aspects, the brake apparatus can comprise a brake retainer that defines a central bore. The brake retainer can define a plurality of radial openings positioned in communication with the central bore. A driving member can be disposed within the central bore of the brake retainer. The driving member can have an outer surface defining at least one wedge surface. A plurality of braking elements can be positioned in contact with at least a portion of the outer surface of the driving member. A biasing member can be operatively coupled to the driving member. The biasing member of the brake retainer can be configured to bias the driving member in a proximal direction relative to the longitudinal axis. The at least one wedge surface of the driving member can be configured to drive the plurality of braking elements radially outwardly into corresponding radial openings of the brake retainer to engage the inner surface of the drill string.

A method can comprise releasing a plug assembly from a drill string sub that is coupled to a drill string. The plug assembly can comprise a brake apparatus that is configured to inhibit proximal movement of the plug assembly. The plug assembly can be pumped distally until the plug assembly engages a reverse circulation overshot.

DETAILED DESCRIPTION

Figure 1:
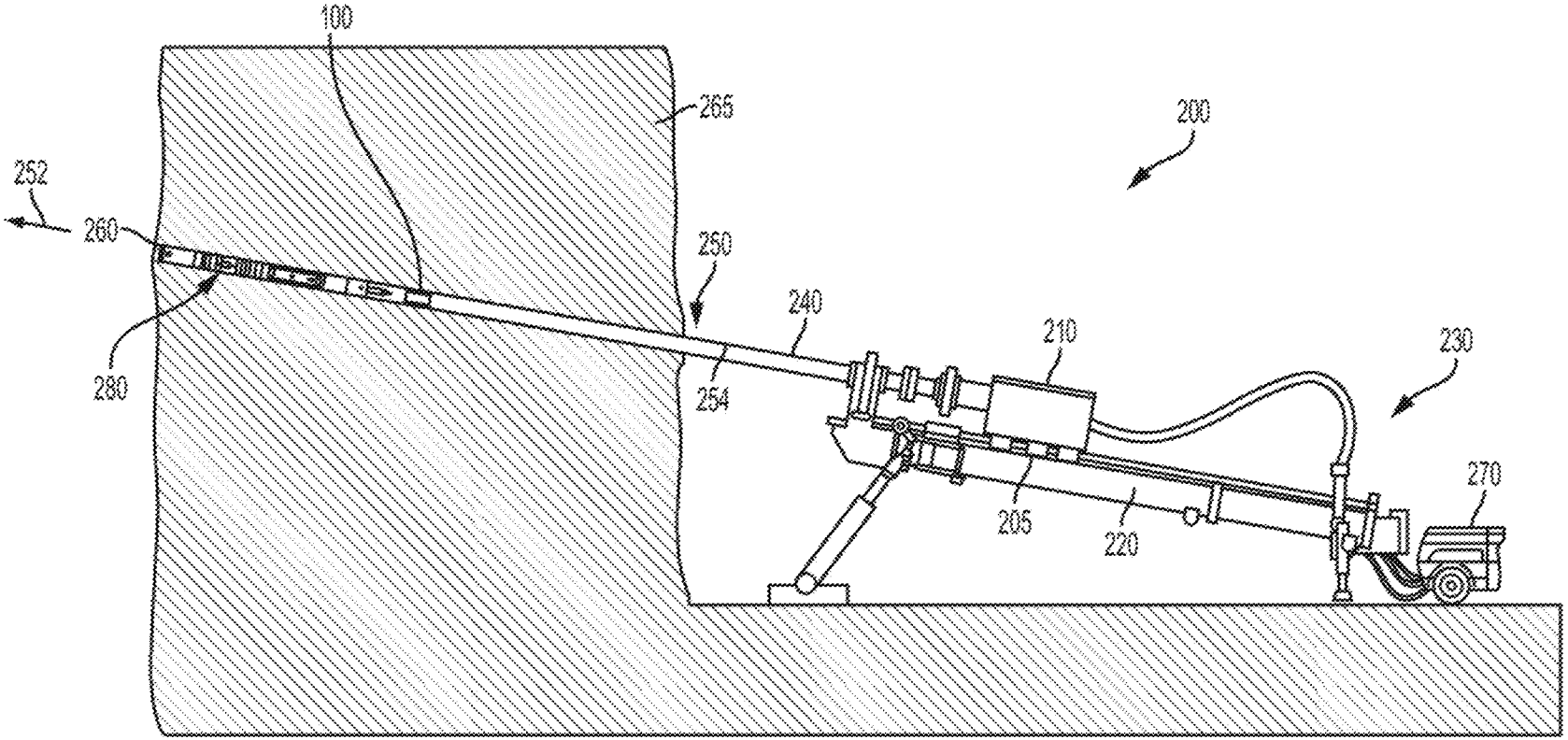
FIG. 1 is a drilling system in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. For example, use of the term "a wedge surface" can refer to one or more of such wedge surfaces.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, in some optional aspects, when values are approximated by use of the terms "approximately," "substantially," or "generally," it is contemplated that values within up to 15%, up to 10%, up to 5%, or up to 1% (above or below) of the particular value can be included within the scope of those aspects. When used with respect to an identified property or circumstance, "substantially" or "generally" can refer to a degree of deviation that is sufficiently small so as to not measurably detract from the identified property or circumstance, and the exact degree of deviation allowable may in some cases depend on the specific context.

As used herein, the term "proximal" refers to a direction toward a drill rig or drill operator (and away from a formation or borehole), while the term "distal" refers to a direction away from the drill rig or drill operator (and into a formation or borehole).

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry.

FIG. 1 illustrates a drilling system 200 (e.g., an underground drilling system) that includes a sled assembly 205 and a drill head 210. The sled assembly 205 can be coupled to a slide frame 220 as part of a drill rig 230. The drill head 210 is configured to have one or more threaded member(s) 240 coupled thereto. Threaded members can include, without limitation, drill rods and/or casings. For ease of reference, the tubular threaded member 240 will be described as a drill rod. The drill rod 240 can in turn be coupled to additional drill rods to form a drill string 250. In turn, the drill string 250 can be coupled to a core barrel assembly having a drill bit 260 or other in-hole tool configured to interface with the material to be drilled, such as a formation 265.

In the illustrated example, the slide frame 220 can be oriented such that the drill string 250 is generally horizontal or oriented upwardly relative to the horizontal. Further, the drill head 210 is configured to rotate the drill string 250 during a drilling process. In particular, the drill head 210 may vary the speed at which the drill head 210 rotates as well as the direction of rotation. The rotational rate of the drill head and/or the torque the drill head 210 transmits to the drill string 250 may be selected as desired according to the drilling process.

The sled assembly 205 can be configured to translate relative to the slide frame 220 to apply an axial force to the drill head 210 to urge the drill bit 260 into the formation 265 as the drill head 210 rotates. In the illustrated example, the drilling system 200 includes a drive assembly 270 that is configured to move the sled assembly 205 relative to the slide frame 220 to apply the axial force to the drill bit 260 as described above. As will be discussed in more detail below, the drill head 210 can be configured in a number of ways to suit various drilling conditions.

The drilling system 200 can further include an inner tube assembly 280 (also referred to as a head assembly or core barrel head assembly, as further disclosed herein), that is configured to receive a core sample.

Figure 2:
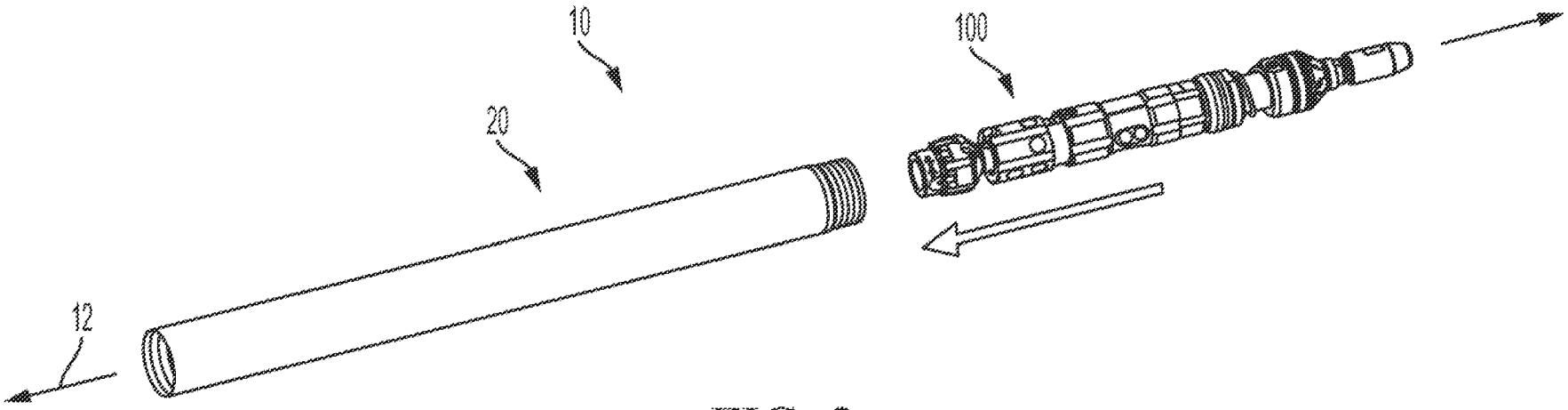
FIG. 2 is a perspective view of a system comprising a drill string sub and a plug assembly in accordance with embodiments disclosed herein.

With reference to FIG. 2, a reverse circulation overshot engagement system 10 can comprise a drill string sub 20 and plug assembly 100, as further disclosed herein. In some aspects, the drill string sub 20 can be configured to be coupled to a proximal rod of the drill string 250 so that the drill string sub 20 is the most proximal component of the drill string (i.e., the component of the drill string closest to the drill rig 230). In further aspects, one or more additional components can be proximal of the drill string sub 20. Such additional components can include, for example and without limitation, a water swivel for pumping fluid during drilling and for pumping components (e.g., the reverse circulation overshot) distally, or a loading chamber or fluid recovery system for use when pumping components (e.g., the reverse circulation overshot and core head assembly) proximally.

As further disclosed herein, the plug assembly 100 can be configured to help prevent unintended expulsion of drilling tools and devices (e.g., a head assembly 280) from a borehole in the formation 265.

Figure 5:
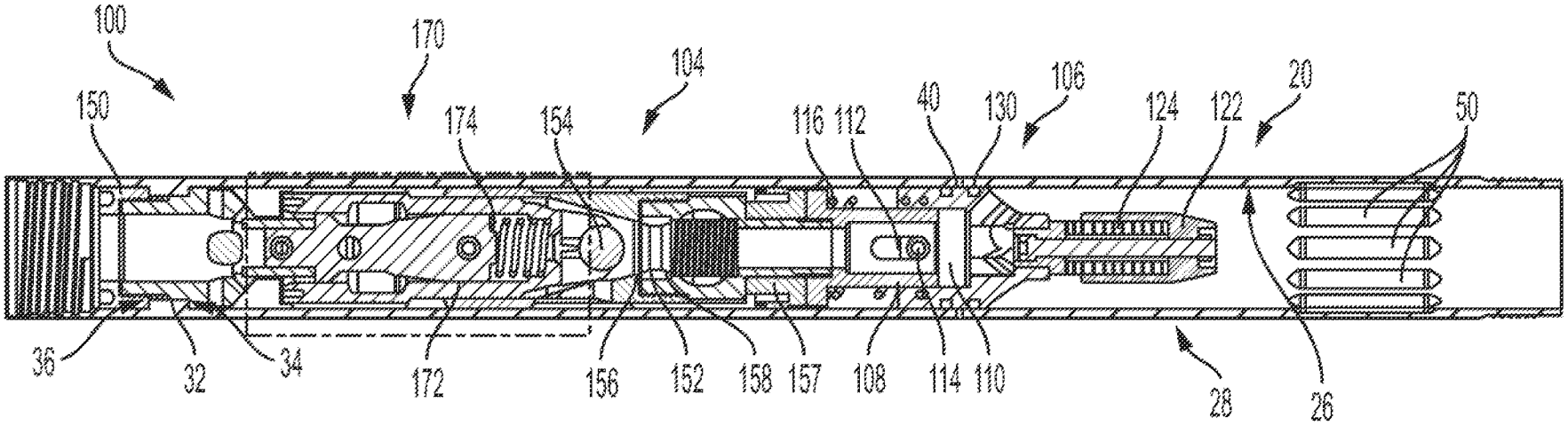
FIG. 5 is a cross sectional view of the system of FIG. 3.
Figure 6:
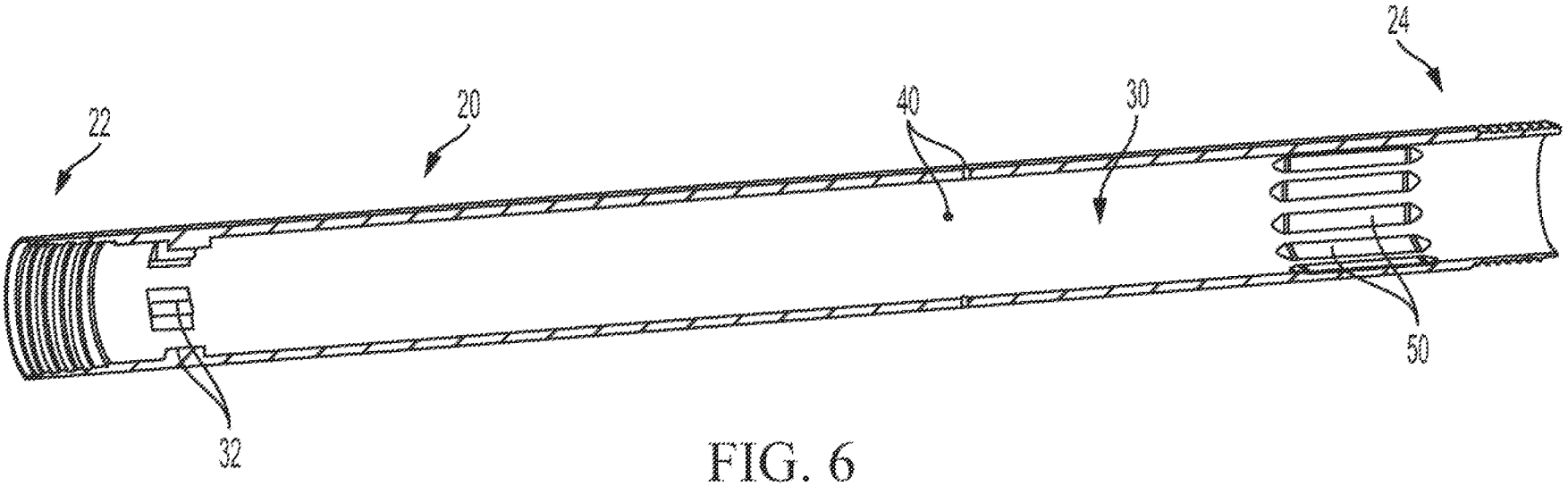
FIG. 6 is a cross sectional view of the drill string sub of FIG. 2.

Referring to FIGS. 2 and 5-6, the reverse circulation overshot engagement system 10 can have a central axis 12. The drill string sub 20 can comprise a proximal end 22, a distal end 24, an outer surface 28, and an inner surface 26 that defines an inner bore 30. At least the distal end 24 of the drill string sub 20 can be threaded to permit engagement with other drill string components. The plug assembly 100 can be receivable into the inner bore 30 of the drill string sub 20.

The inner surface 26 of the drill string sub 20 can define one or a plurality of internally projecting portions 32. The internally projecting portion(s) 32 can define a first shoulder 34 and a second shoulder 36 that is proximal of the first shoulder 34.

Figure 3:
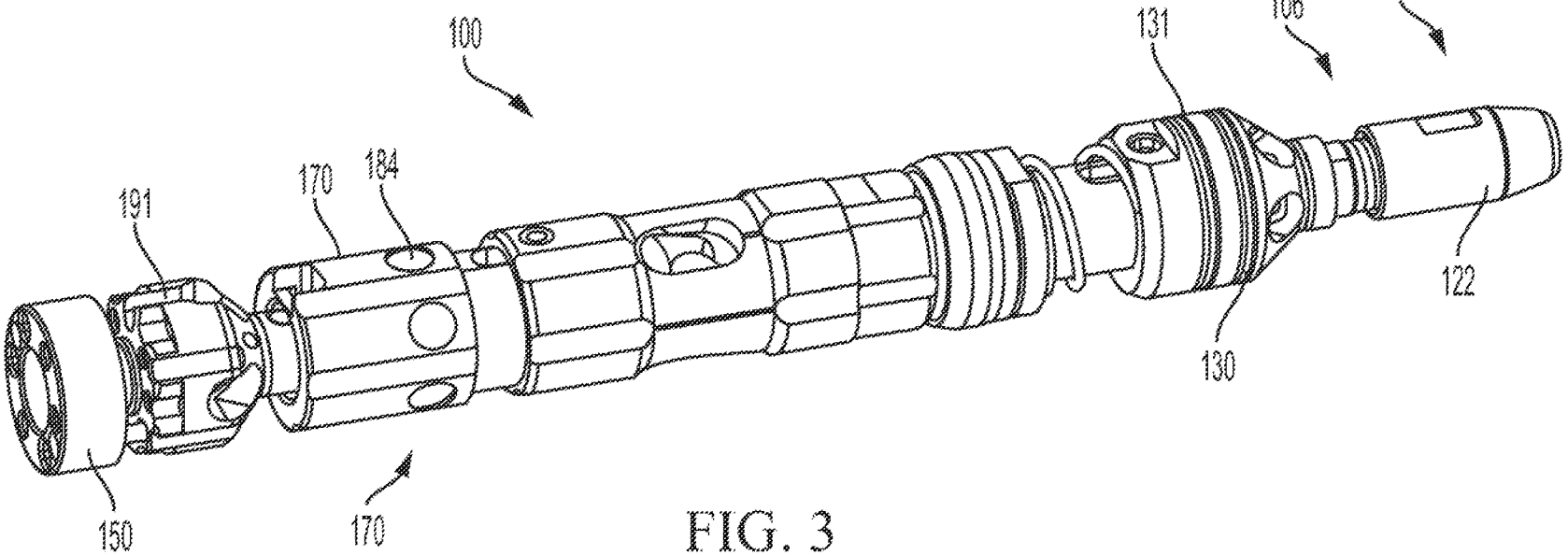
FIG. 3 is a perspective view of the plug assembly of FIG. 2.
Figure 4:
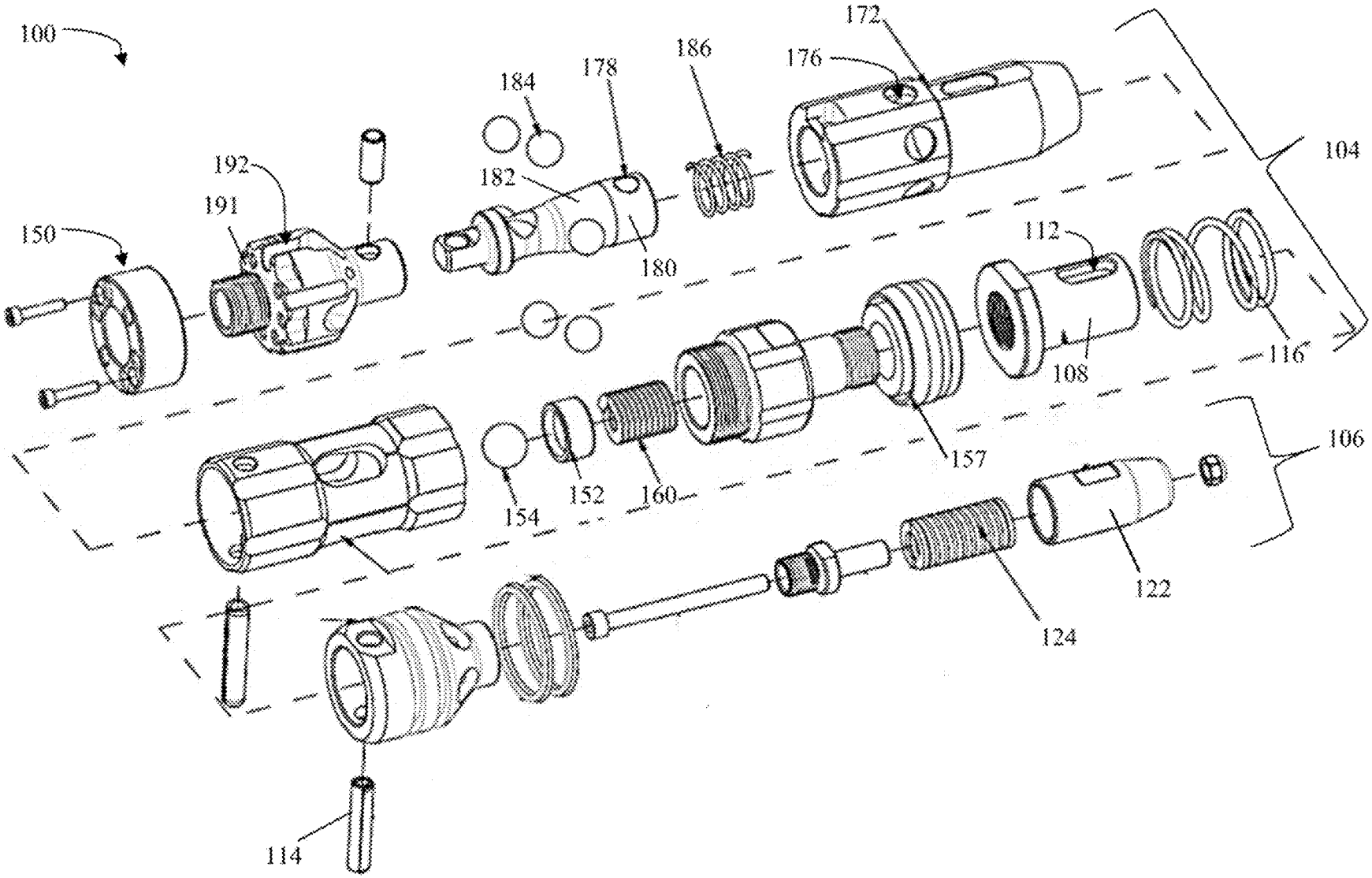
FIG. 4 is an exploded view of the plug assembly of FIG. 2.
Figure 9:
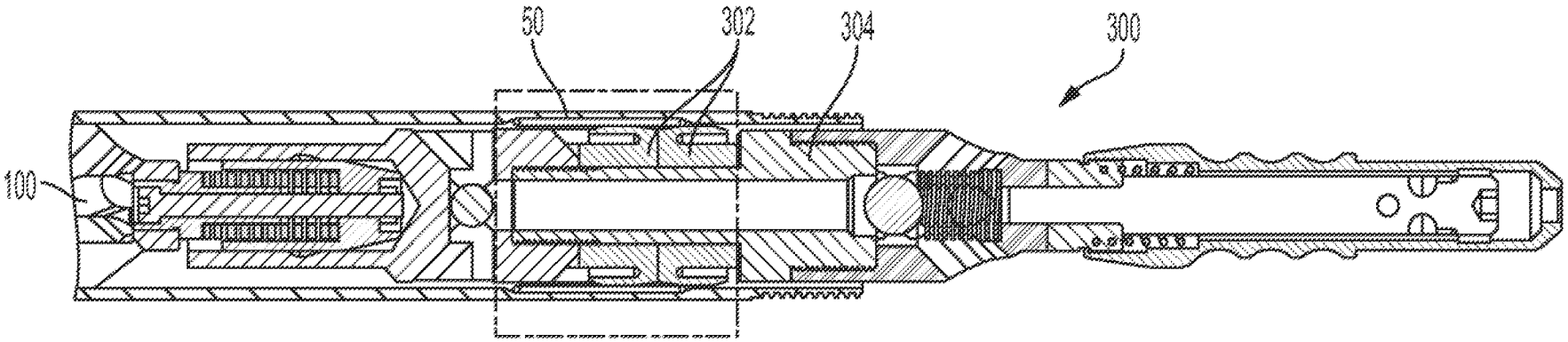
FIG. 9 is a cross sectional view of a reverse circulation overshot engaging the system of FIG. 2.
Figure 10:
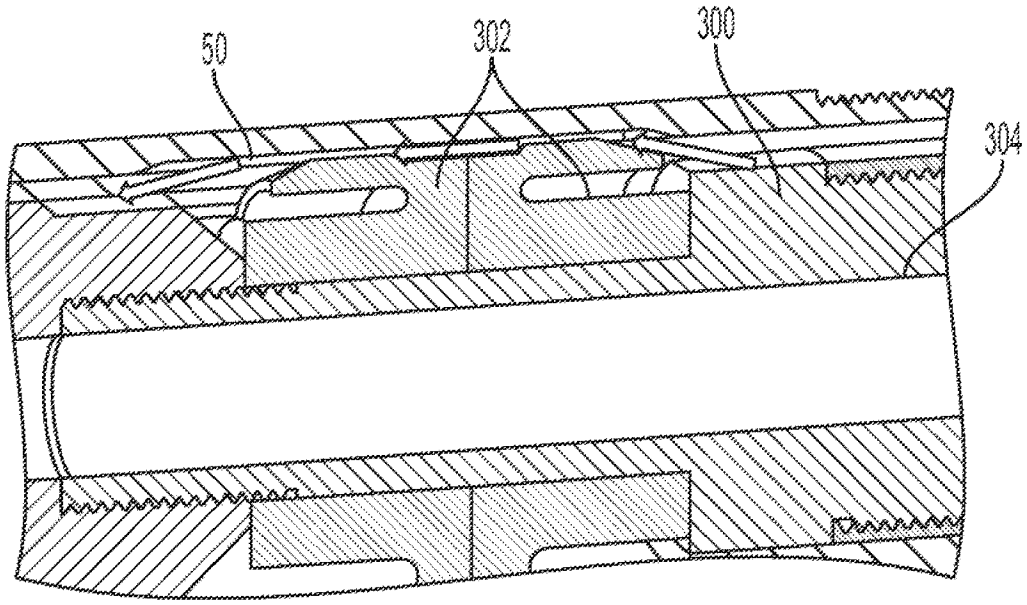
FIG. 10 is a close up partial cross sectional view of the reverse circulation overshot positioned within the drill string sub.
Figure 11:
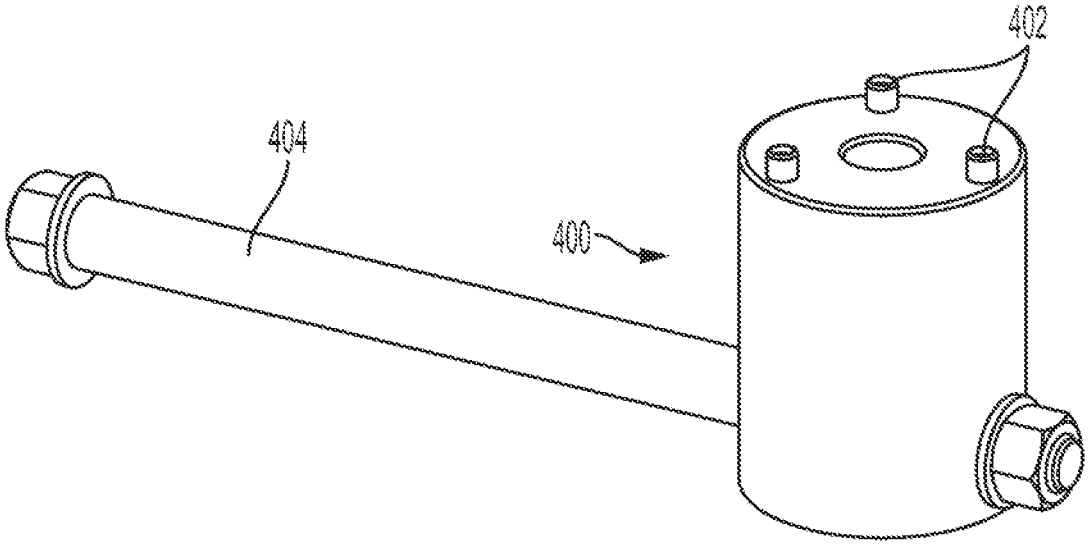
FIG. 11 is a tool for use with the system of FIG. 2.

Referring also to FIGS. 3-5, and as further described herein, the plug assembly 100 and drill string sub 20 can cooperate to define an indicator structure. For example, when retrieving a reverse circulation overshot 300 (FIG. 9) with a head assembly 280 (FIG. 1) coupled thereto, the indicator structure can provide an indication to an operator that the overshot assembly has reached the proximal end of the drill string. The indication can be, for example, a user-detectable change in fluid pressure, as further disclosed herein. As a non-limiting example, the reverse circulation overshot 300 can correspond to an overshot subassembly of the type disclosed in U.S. Patent Application Publication No. 2020/0003021 to Drenth et al., which is incorporated herein by reference in its entirety. For example, the reverse circulation overshot 300 can have a longitudinal axis and have a proximal portion, a distal portion, and a check valve assembly positioned axially between the proximal and distal portions, wherein the distal portion comprises a latch assembly. In these aspects, the latch assembly of the reverse circulation overshot can be configured for movement from a retracted position to a deployed position to engage a proximal portion of a head assembly when the distal portion of the reverse circulation overshot is received within a receptacle of the head assembly. The check valve assembly of the reverse circulation overshot can be biased to the closed position and configured to move from the closed position to the open position upon landing of the drilling assembly within a borehole.

The plug assembly 100 can comprise a proximal subassembly 104 and a distal subassembly 106 that is coupled to the proximal subassembly 104. The proximal subassembly 104 can be configured to bias against the first shoulder 34 of the drill string sub to restrict proximal axial movement of the proximal subassembly 104. A retainer nut 150 can couple to the proximal subassembly 104 (e.g., via threads). The retainer nut 150 can bias against the second shoulder 36 to inhibit distal movement of the plug assembly 100.

The distal subassembly 106 can be slidably coupled to the proximal subassembly 104 so that the distal subassembly 106 can move axially relative to the proximal subassembly. For example, the proximal subassembly 104 can define a distal end 108 (e.g., a cylindrical distal end) that is receivable into a complementary bore 110 (e.g., a cylindrical bore) of the distal subassembly 106. The distal end 108 of the proximal subassembly 104 can define a slot 112 that receives a projection 114 (optionally embodied as a spring pin, as shown in FIG. 4) of the distal subassembly 106 to restrict axial movement of the distal subassembly. A biasing element 116 (e.g., a spring) can bias the distal subassembly 106 distally to a first position in which the projection 114 of the distal subassembly biases against a distal end of the slot 112 of the proximal subassembly 104. The biasing element 116 can bias the distal subassembly 104 distally toward the first position.

Figure 8:
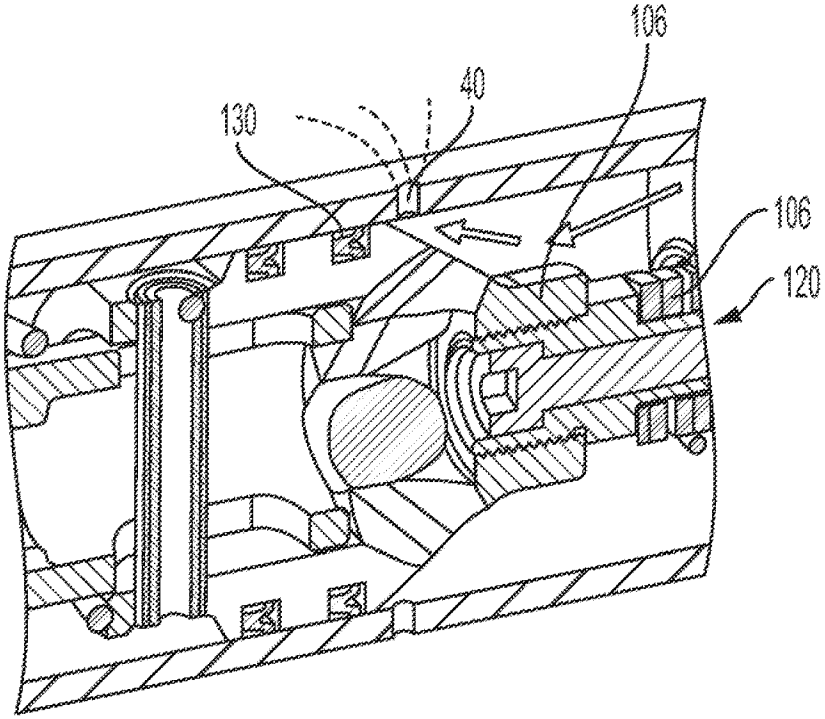
FIG. 8 is a cross sectional perspective view of the portion of the system of FIG. 7, with the distal subassembly of the plug assembly in a second position that is axially offset from the first position.
Figure 7:
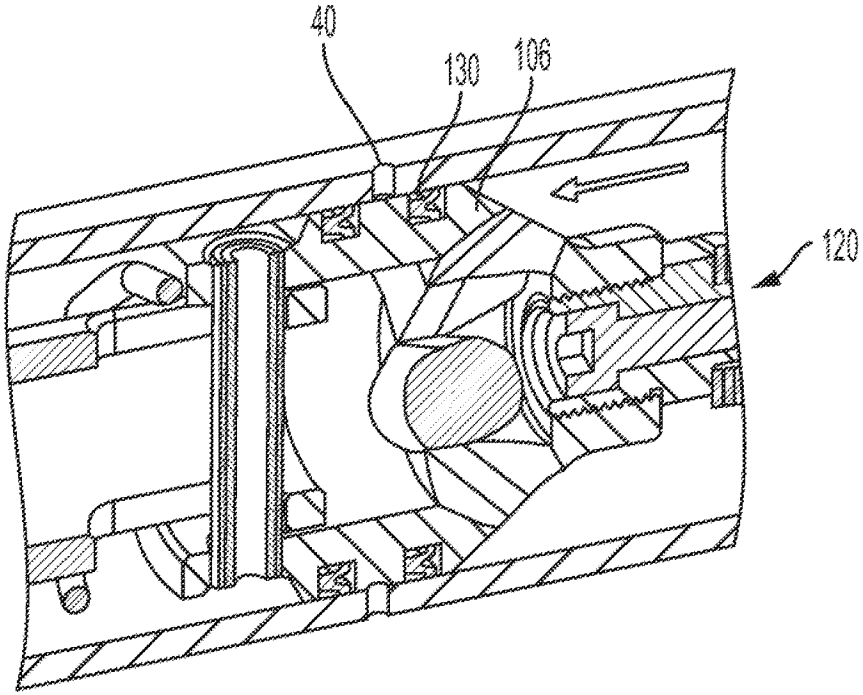
FIG. 7 is a cross sectional perspective view of a portion of the system of FIG. 2 that can serve as an indicator, with a distal subassembly of the plug assembly in a first position.

Referring also to FIGS. 7-8, the distal subassembly 106 can comprise a receiver end 120 that is configured to engage a proximal end of the reverse circulation overshot 300. For example, optionally, the receiver end 120 can be inserted into a cavity or opening in the proximal end of the reverse circulation overshot 300. With reference to FIG. 4, the receiver end 120 can comprise an axially slidable tip 122, and a spring 124 that is configured to bias the slidable tip 122 so that when the reverse circulation overshot 300 impacts the slidable tip 122, the spring 124 decelerates an impacting reverse circulation overshot. The weight of the reverse circulation overshot and coupled head assembly 280 (FIG. 1) and weight of a fluid column distal of the head assembly as well as any pressure applied via reverse circulation can drive the distal subassembly 106 proximally relative to the proximal subassembly 104. The drill string sub 20 can define one or more through-holes 40 extending between the outer surface 28 and the inner surface 26. The distal subassembly can comprise a seal 130 that biases against the inner surface of the drill string sub to inhibit fluid travel between the distal subassembly and the inner surface of the drill string sub. When the distal subassembly 106 is in the first position, the seal 130 can be distal of the through-holes 40 by a first distance. The biasing element 116 and the first distance can cooperate to produce or define a threshold proximal force that, when surpassed, causes the distal subassembly to travel proximally until the seal is proximal of the at least one through-hole 40 of the drill string sub 20. Optionally, the threshold proximal force can be selected so that the weight of the reverse circulation overshot 300 and a coupled head assembly, when in a drill string angled 20 degrees upwardly from a horizontal position, applies the threshold proximal force. A second seal 131 can inhibit ejecting fluid through the holes 40 when the distal subassembly has not received the reverse circulation overshot 300.

Once the seal 130 travels proximally of the through-holes 40, fluid can travel out of the drill string, thereby causing a pressure change (optionally, an abrupt step pressure change) that can provide an indication to the operator that the overshot 300 has reached the proximal end of the drill string. Water or fluid ejected from the through-holes 40 can further provide a visual indication to the operator that the overshot 300 has reached the proximal end of the drill string.

Figure 19:
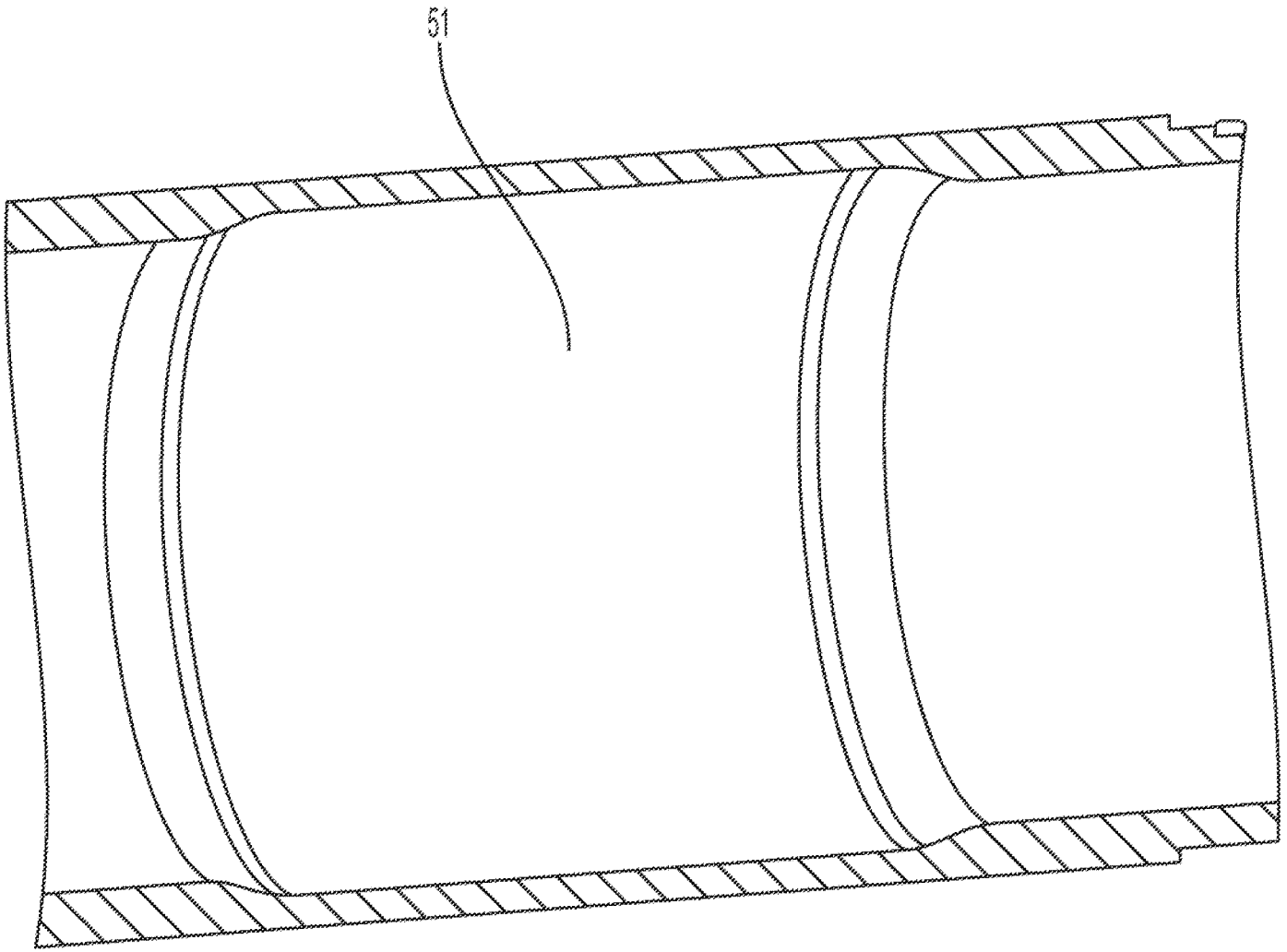
FIG. 19 is a cross section of a drill string sub in accordance with embodiments disclosed herein, having an annular undercut for communicating water around seals of a reverse circulation overshot.

Referring to FIGS. 5-6 and 9-10 it is contemplated that fluid can travel proximally around the reverse circulation overshot and to the holes 40, yet the reverse circulation overshot 300 has seals 302 that inhibit fluid flow there-around, with the seals 302 positioned around, for example, a spindle 304 (e.g., a hollow spindle). Accordingly, the inner surface 26 of the drill string sub 20 can define one or more longitudinally extending grooves 50 that extend radially outwardly from the inner bore 30. The longitudinally extending grooves 50 can define a bypass to communicate fluid around the seals 302 of the reverse circulation overshot 300 when engaging the receiver end 120. Accordingly, the longitudinally extending grooves 50 can be positioned at a location relative to the central axis based on a position of the seals 302 of the overshot 300 when the overshot is biasing against the receiver end 120 and the distal subassembly is shifted proximally from its first position. In further optional aspects, other features can be used to enable fluid to travel around the seals 302 of the overshot 300. For example, instead of the plurality of longitudinally extending grooves, referring to FIG. 19, one large undercut (e.g., an annular recess 51) can provide such fluid communication (around the seals 302 of the overshot 300).

As stated herein, the first shoulder 34 that biases against the proximal subassembly 104 to restrict proximal movement thereof can retain the plug subassembly 100 within the drill string sub 20. Accordingly, the overshot 300 and coupled head assembly 280 cannot fall out of the drill string as long as the drill string sub 20 is attached to the drill string. However, in certain circumstances, when retrieving a coupled pair of a reverse circulation overshot 300 and coupled head assembly 280, the coupled pair can get stuck within the drill string, often at an unknown location along the drill string. To retrieve the stuck overshot 300, drill rods can be sequentially removed from the proximal end of the drill string. However, in doing so, the drill string sub 20 must be removed, thereby removing the stop that prevents the overshot from falling out. As can be understood, particularly for up-hole drilling, if the reverse circulation overshot 300 and head assembly 280 become dislodged with the drill string sub 20 removed from the drill string, the reverse circulation overshot and head assembly, as well as fluid trapped therebehind, can be inadvertently released, thereby causing a safety risk. Accordingly, in some aspects, the plug assembly 100 can be pumped into the drill string toward (optionally, to) the overshot and subsequently serve as a brake to inhibit unwanted discharge of the overshot and head assembly as proximal drill rods are sequentially removed to retrieve the stuck overshot.

Figure 12:
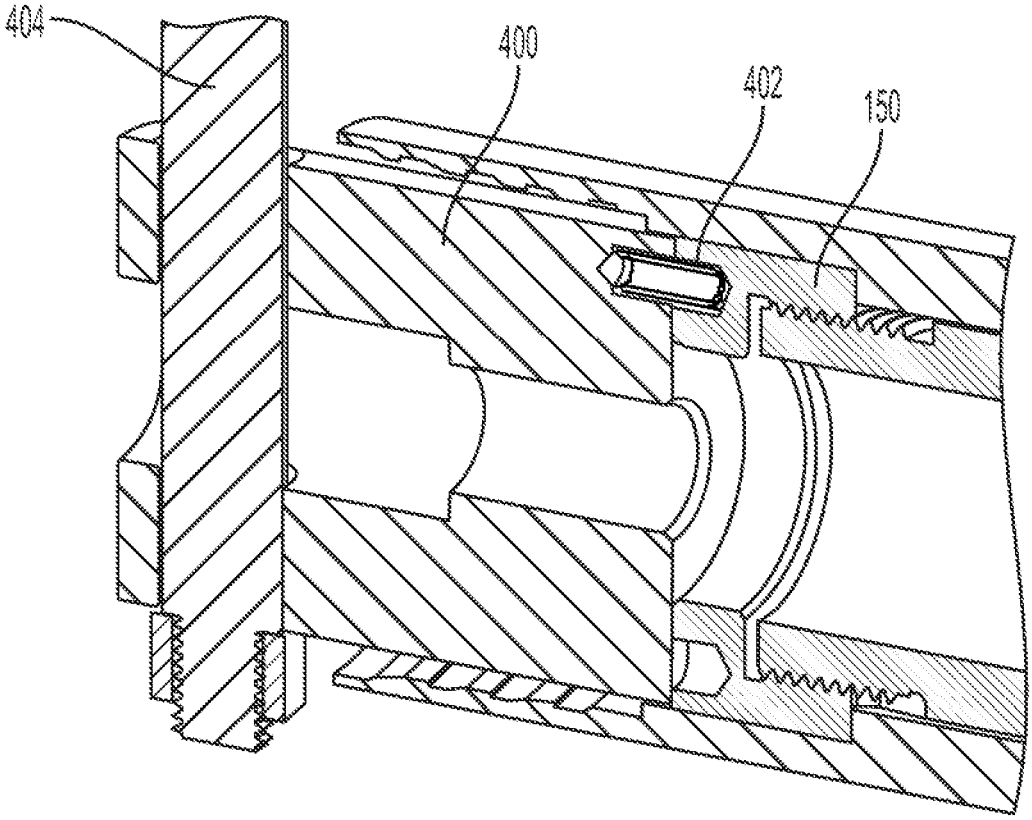
FIG. 12 is a sectional view of the tool of FIG. 11 engaging the plug assembly of FIG. 2.
Figure 13:
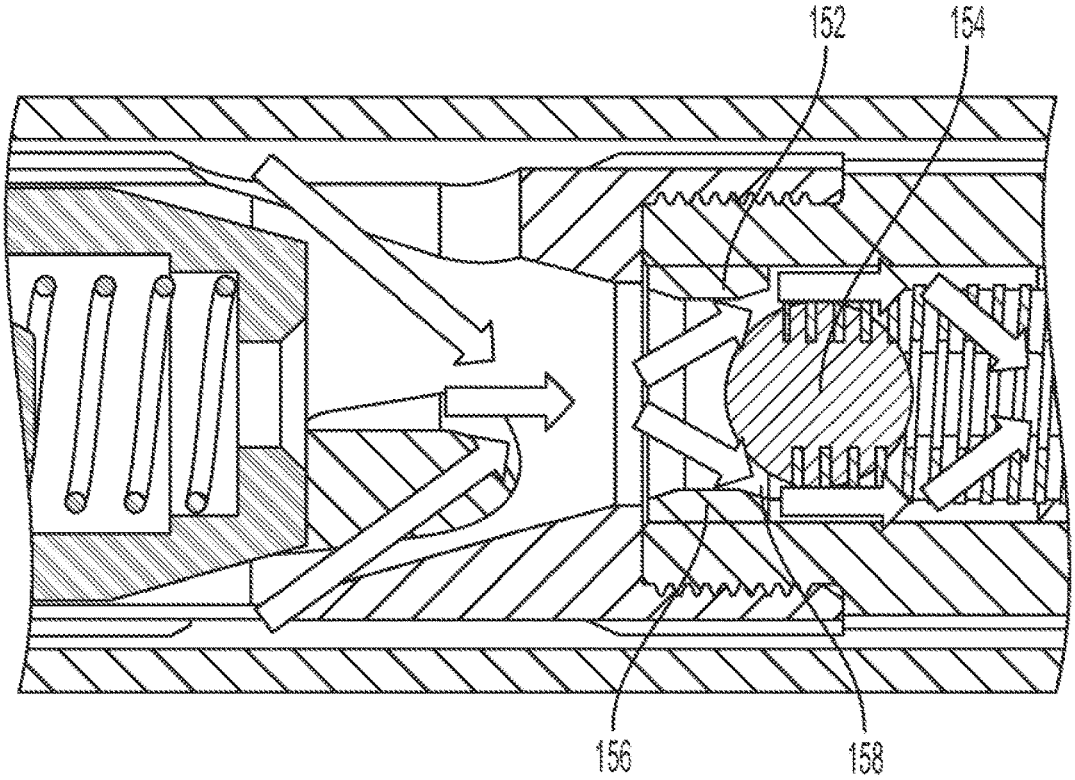
FIG. 13 is a cross sectional view of a valve of the system of FIG. 2 showing fluid flow in a first direction.

Referring to FIGS. 3-5, 11, and 12, a retainer nut 150 can couple to the proximal subassembly 104 (e.g., via threads). The retainer nut 150 can be positioned proximally of the second shoulder 34 of the drill string sub 20 and configured to bias against the second shoulder 34 to inhibit distal movement of the plug assembly 100. The retainer nut 150 can be decoupled from the proximal subassembly 104 to allow the plug assembly 100 to be pumped distally along the drill string. For example, a tool 400 can define a handle 404 and a plurality of projections 402 that are receivable within corresponding receptacles of the retainer nut 150. With the projections 402 received within corresponding receptacles of the retainer nut 150 as shown in FIG. 12, torque (e.g., rotation) applied to the handle 404 can decouple the retainer nut 150 from the proximal subassembly 104.

Figure 14:
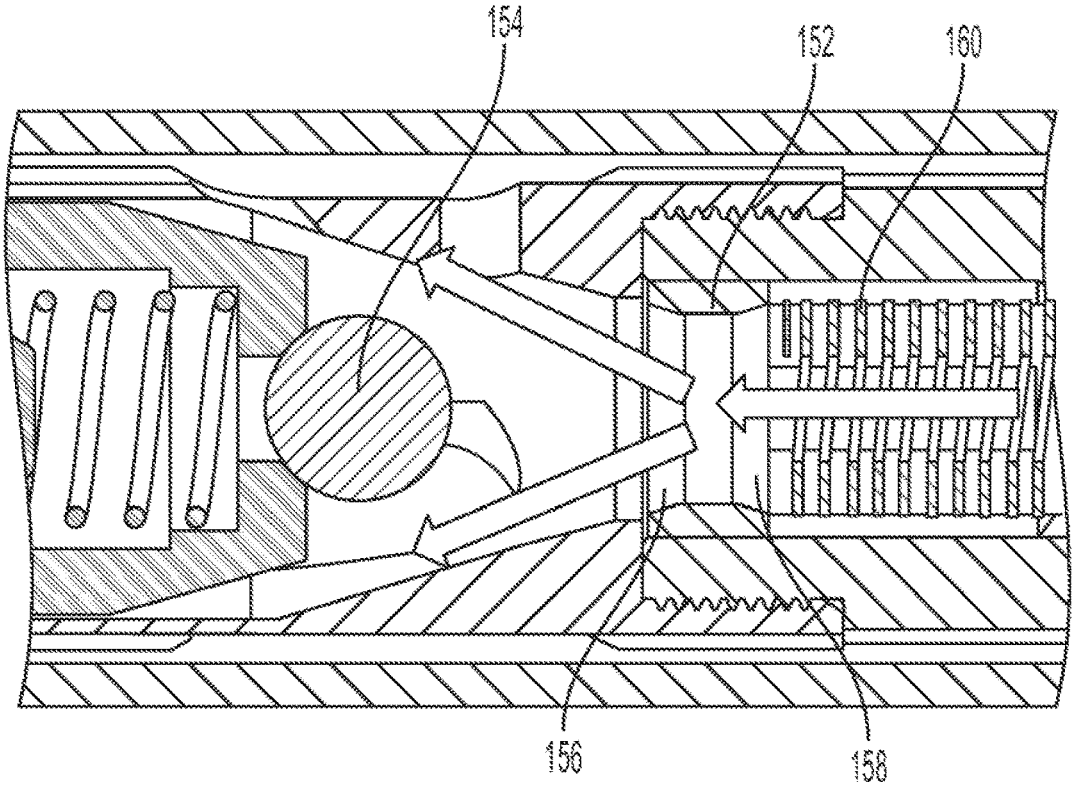
FIG. 14 is a cross sectional view of the valve of FIG. 13 with a ball of the valve in a second position and showing fluid flow in a second direction.
Figure 15:
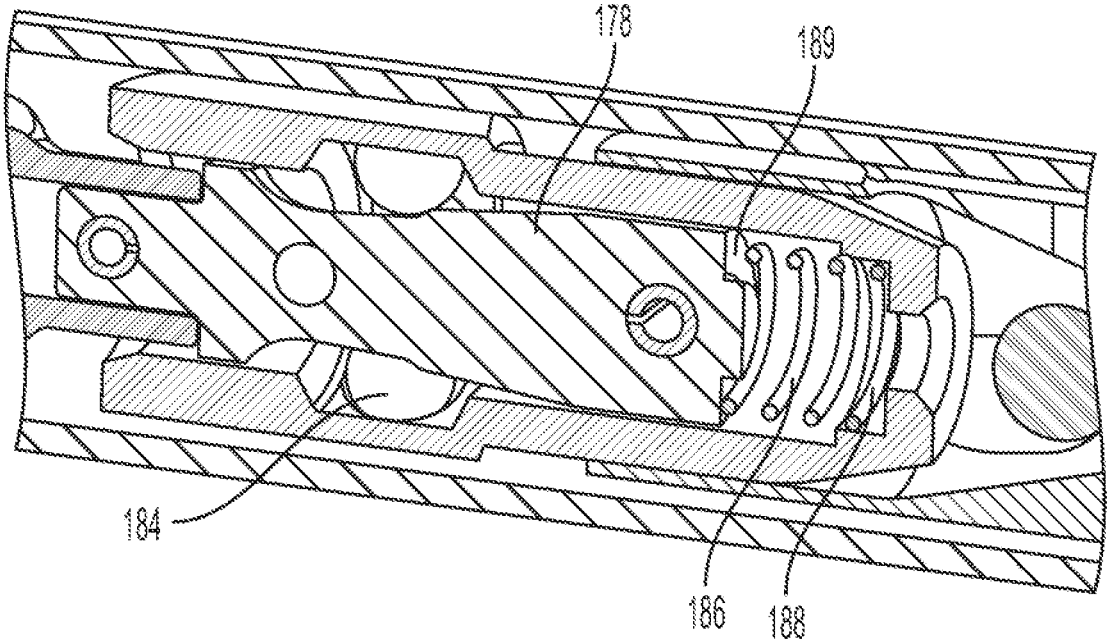
FIG. 15 is a cross sectional view of a brake apparatus of the plug assembly.
Figure 16:
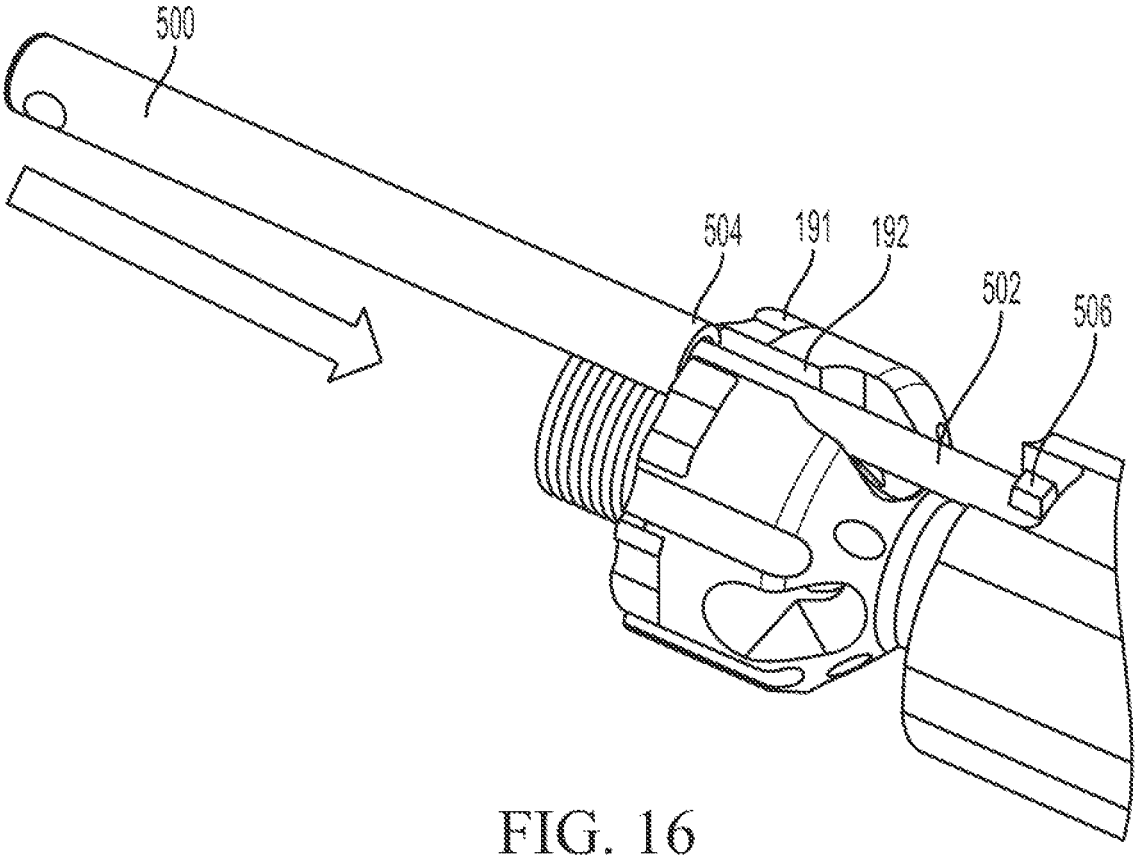
FIG. 16 is a partial perspective view of a brake disengagement key engaging an end of the plug assembly of FIG. 2.
Figure 17:
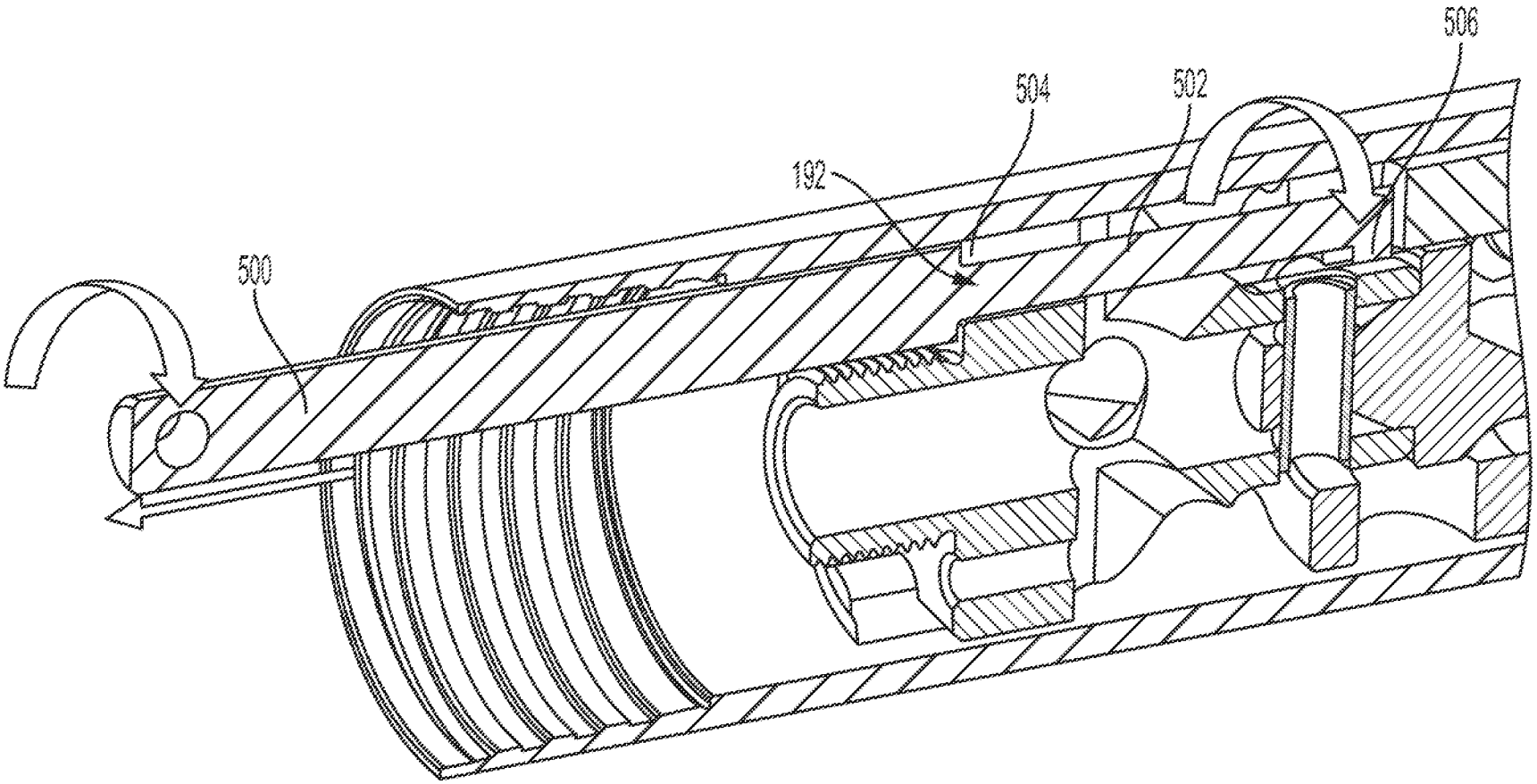
FIG. 17 is a sectional view of the brake disengagement key engaging the end of the plug assembly of FIG. 2.
Figure 18:
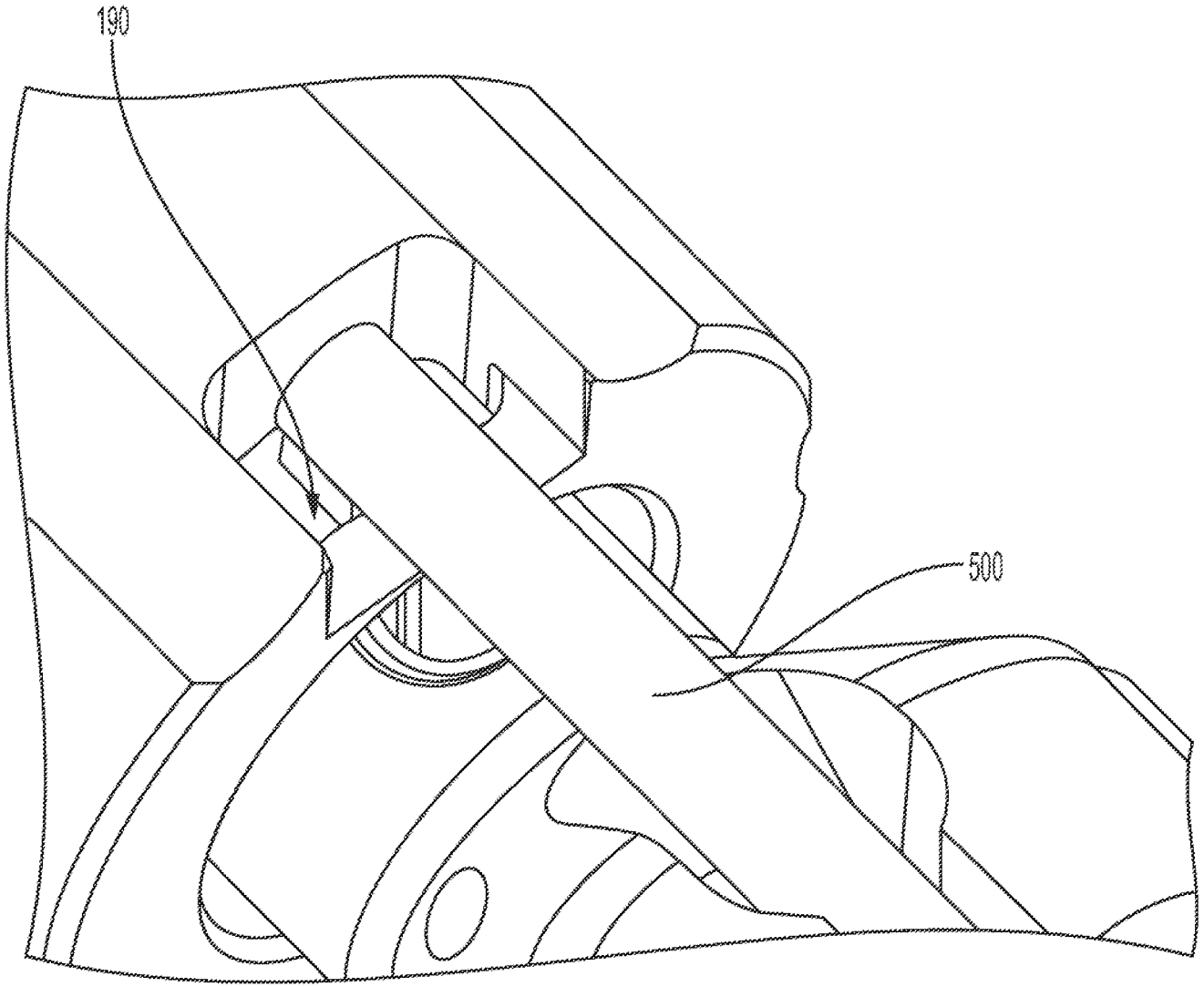
FIG. 18 is another partial perspective view of the brake disengagement key engaging the end of the plug assembly of FIG. 2.

Referring to FIGS. 1, 3-5, 13, and 14, the proximal subassembly can comprise a valve seat 152 and a valve ball 154 that is configured to engage the valve seat 152. The valve ball can engage the valve seat 152 on a first side 156 so that fluid is inhibited from traveling through the valve seat 152. A seal 157 can engage an inner surface 254 of the drill string 250 to inhibit fluid flow between the outer surface of the plug assembly 100 and the inner surface of the drill string. Accordingly, fluid pressure applied at a proximal end of the plug assembly 100 can drive the plug assembly distally. The valve ball 154 and valve seat 152 can cooperate to produce or define a threshold pressure. Once the plug assembly 100 engages the stuck overshot 300, the fluid pressure can build behind the valve ball 154 until the pressure exceeds the threshold pressure, at which point, the valve ball can travel through the valve seat, resulting in an abrupt pressure change. Accordingly, the threshold pressure is indicative of the receptacle of the distal subassembly of the plug assembly 100 engaging the reverse circulation overshot 300. Thus, the valve ball 154 and valve seat 152 can cooperate to define an overshot engagement indicator. A spring 160 can bias the valve ball toward a second side 158 of the valve seat 152. Optionally, it is contemplated that the valve seat 152 can be a bushing (e.g., an indicator bushing) as is known in the art. Optionally, as shown in FIG. 14, the first and second sides 156, 158 of the valve seat 152 can define respective tapered or frustoconical surfaces that converge at an intermediate portion of the valve seat that defines a minimum internal diameter of the valve seat.

As disclosed herein, the plug assembly 100 can comprise or define a brake apparatus 170 that is configured to inhibit proximal movement of the plug assembly. In some aspects, the proximal subassembly 104 can comprise a brake retainer 172 that defines a central bore 174 and a plurality of radial openings 176 positioned in communication with the central bore 174. A driving member 178 can be positioned within the central bore 174 of the brake retainer 172. The driving member 178 can have an outer surface 180 that defines at least one wedge surface 182. It is contemplated that the wedge surface 182 can have a decreasing radial dimension in the proximal direction.

A plurality of braking elements 184 can be positioned in contact with at least a portion of the outer surface 180 of the driving member 178. The braking elements 184 can optionally be balls or rollers. However, it is contemplated that braking elements 184 having other structures can be used. A biasing member 186 (e.g., a spring) can be operatively coupled to the driving member 178 to bias the driving member in a proximal direction relative to the central axis 12. For example, the biasing member can extend between an end surface 188 of the central bore 174 and a distal end 189 of the driving member 178.

As the plug assembly 100 travels in the distal direction, the braking elements 184 can bias against the inner surface of the drill string, thereby causing the braking elements to rotate. Such rotation of the braking elements 184 can drive the driving member 178 distally. However, any proximal movement of the plug assembly 100 causes the braking elements 184 to rotate in the opposite direction, thereby driving the driving member proximally and causing the wedge surface 182 to force the braking elements 184 more forcefully against the inner surface of the drill string. This forms a feedback loop that inhibits substantial proximal movement of the plug assembly 100. Accordingly, this configuration inhibits proximal movement of the plug assembly 100 while allowing distal movement of the plug assembly.

Once the brake apparatus 170 is engaged, drill rods can sequentially be removed from the proximal end of the drill string until the rod with the plug assembly 100 therein is serving as the (most) proximal drill rod. The proximal drill rod can be removed, and the plug assembly, reverse circulation overshot, and head assembly can all be removed distally from said proximal drill rod.

Referring to FIGS. 4-5 and 15-17, the brake apparatus 170 can be disengaged via application of a distal force against the driving member to overcome the force of the biasing member 186, thereby moving the driving member 178 distally. Accordingly, the plug assembly 100 can be configured to enable an operator to provide said distal force. In some aspects, the proximal subassembly 106 can comprise an end component 191 that is operatively coupled to the driving member 178. The end component 191 can define a slot 192 that is configured to receive a brake disengagement key 500 therethrough. The key 500 can comprise a shaft 502, a shoulder 504, and a radial projection 506 that extends from the shaft 502 at a predetermined axial spacing from the shoulder 504. The key can be inserted through the slot 192 of the end component, and the shoulder 504 can bias against the end component 191 to drive the driving member 178 proximally to release the brake apparatus 170. The brake retainer 172 can define a lip 190, and the radial projection 506 can extend past said lip 190 when the driving member is positioned so that the brake apparatus 170 is disengaged. Once the radial projection 506 extends past the lip 190, the key 500 can be rotated to engage the lip, thereby retaining the brake apparatus 170 in a disengaged configuration.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A system having a longitudinal axis, the system comprising: a drill string sub that is configured to couple to a drill rod of a drill string having an inner surface, wherein the drill string sub comprises an outer surface and an inner surface defining an inner bore; and a plug assembly that is received within the inner bore of the drill string sub and releasably coupled to the drill string sub, wherein, when decoupled from the drill string, the plug assembly is configured to be pumped into the drill string, wherein the plug assembly comprises: a distal subassembly that defines a receiver that is configured engage a reverse circulation overshot; and a proximal subassembly that is coupled to the distal subassembly, wherein the proximal subassembly comprises a brake apparatus that is configured to inhibit proximal movement of the plug assembly.

Aspect 2: The system of aspect 2, wherein the brake apparatus comprises: a brake retainer that defines a central bore, wherein the brake retainer defines a plurality of radial openings positioned in communication with the central bore; a driving member disposed within the central bore of the brake retainer, wherein the driving member has an outer surface defining at least one wedge surface; a plurality of braking elements positioned in contact with at least a portion of the outer surface of the driving member; and a biasing member that is operatively coupled to the driving member, wherein the biasing member of the brake retainer is configured to bias the driving member in a proximal direction relative to the longitudinal axis, wherein the at least one wedge surface of the driving member is configured to drive the plurality of braking elements radially outwardly into corresponding radial openings of the brake retainer to engage the inner surface of the drill string.

Aspect 3: The system of aspect 1 or aspect 2, wherein the drill string sub defines a first shoulder and a second shoulder that is proximal of the first shoulder, wherein the proximal subassembly of the plug assembly is configured to bias against the first shoulder of the drill sub to limit proximal movement of the proximal subassembly.

Aspect 3A: The system of aspect 3, wherein the system further comprises a retainer nut that is coupled to the proximal subassembly of the plug assembly, wherein the retainer nut is positioned proximally of the second shoulder and extends sufficiently radially outwardly to engage the second shoulder to inhibit distal movement of the plug assembly.

Aspect 4: The system of aspect 3 or aspect 3A, wherein the plug assembly comprises at least one thread, wherein the retainer nut defines at least one thread that is configured to threadedly engage the at least one thread of the plug assembly.

Aspect 5: The system of any one of aspect 1-4, wherein the proximal subassembly comprises: a valve ball; and a valve seat that is configured to cooperate with the valve ball to produce a threshold pressure, wherein a fluid pressure in excess of the threshold pressure is configured to drive the valve ball through the valve seat.

Aspect 6: The system of aspect 5, wherein the threshold pressure is indicative of the receptacle of the distal subassembly of the plug assembly engaging the reverse circulation overshot assembly.

Aspect 7: The system of any one of aspects 1-6, wherein the distal subassembly is slidably coupled to the proximal subassembly relative to the longitudinal axis, wherein the distal subassembly comprises a seal that is configured to bias against the inner surface of the drill string sub to inhibit fluid travel between the distal subassembly and the inner surface of the drill string sub.

Aspect 7A: The system of aspect 7, wherein the plug assembly further comprises: a biasing element that is configured to bias the distal subassembly distally to a first position, wherein, in the first position, the seal of the distal subassembly is distal of the at least one through-hole by a first distance.

Aspect 7B: The system of aspect 7A, wherein in response to a distal force that surpasses a threshold proximal force provided by the biasing element, the distal subassembly is configured to travel proximally until the seal of the distal subassembly is proximal of the at least one through-hole of the drill string sub.

Aspect 8: The system of any one of aspects 7-7B, wherein the receiver comprises a spring that is configured to decelerate the reverse circulation overshot upon contact with the receiver.

Aspect 9: The system of aspect 8, wherein the inner surface of the drill string sub further defines at least one longitudinally extending groove that extends radially outwardly from the inner bore, wherein the at least one longitudinally extending groove is configured to enable fluid communication around a circumferential seal of a reverse circulation overshot when the reverse circulation overshot is in engagement with the receiver of the distal subassembly of the plug assembly.

Aspect 10: A method of using the system of claim any one of aspects 1-9, wherein the drill string sub defines a first shoulder and a second shoulder that is proximal of the first shoulder, wherein the proximal subassembly of the plug assembly is configured to bias against the first shoulder of the drill sub to limit proximal movement of the proximal subassembly, wherein the system further comprises a retainer nut that is coupled to the proximal subassembly of the plug assembly, wherein the retainer nut is positioned proximally of the second shoulder and extends sufficiently radially outwardly to engage the second shoulder to inhibit distal movement of the plug assembly, the method further comprising: coupling the drill string sub to a proximal end of the drill string with the plug assembly within the sub.

Aspect 11: The method of aspect 10, wherein the drill string sub defines a first shoulder and a second shoulder that is proximal of the first shoulder, wherein the proximal subassembly of the plug assembly is configured to bias against the first shoulder of the drill sub to limit proximal movement of the proximal subassembly, wherein the system further comprises a retainer nut that is coupled to the proximal subassembly of the plug assembly, wherein the retainer nut is positioned proximally of the second shoulder and extends sufficiently radially outwardly to engage the second shoulder to inhibit distal movement of the plug assembly.

Aspect 11A: The method of aspect 11, wherein the distal subassembly is slidably coupled to the proximal subassembly relative to the longitudinal axis, wherein the distal subassembly comprises a seal that is configured to bias against the inner surface of the drill string sub to inhibit fluid travel between the distal subassembly and the inner surface of the drill string sub.

Aspect 11B: The method of aspect 11A, wherein the plug assembly further comprises: a biasing element that is configured to bias the distal subassembly distally to a first position, wherein, in the first position, the seal of the distal subassembly is distal of the at least one through-hole by a first distance.

Aspect 11C: The method of aspect 11B, wherein in response to a distal force that surpasses a threshold proximal force provided by the biasing element, the distal subassembly is configured to travel proximally until the seal of the distal subassembly is proximal of the at least one through-hole of the drill string sub, the method further comprising: causing a reverse circulation overshot to move proximally in a drill string until the distal subassembly moves the first distance from the first position; and detecting a change in fluid pressure in the drill string corresponding to fluid exiting the at least one through-hole.

Aspect 12: The method of aspect 10, further comprising: pumping the plug assembly distally along the drill string until the plug assembly engages the reverse circulation overshot.

Aspect 13: The method of aspect 12, the method further comprising: decoupling the retainer nut from the proximal subassembly of the plug assembly prior to pumping the plug assembly distally along the drill string.

Aspect 14: The method of aspect 12 or aspect 13, wherein the drill string sub defines a first shoulder and a second shoulder that is proximal of the first shoulder, wherein the proximal subassembly of the plug assembly is configured to bias against the first shoulder of the drill sub to limit proximal movement of the proximal subassembly.

Aspect 14A: The method of aspect 14, wherein the system further comprises a retainer nut that is coupled to the proximal subassembly of the plug assembly, wherein the retainer nut is positioned proximally of the second shoulder and extends sufficiently radially outwardly to engage the second shoulder to inhibit distal movement of the plug assembly.

Aspect 14B: The method of aspect 14A, further comprising: detecting, based on a fluid pressure change, engagement of the plug assembly with the reverse circulation overshot.

Aspect 15: The method of any one of aspects 10-14B, further comprising: retracting the driving member proximally relative to the brake retainer; and moving the plug assembly proximally in the drill string until the plug assembly engages first shoulder.

Aspect 16: A method comprising: releasing a plug assembly from a drill string sub that is coupled to a drill string, wherein the plug assembly comprises a brake apparatus that is configured to inhibit proximal movement of the plug assembly; and pumping the plug assembly distally until the plug assembly engages a reverse circulation overshot.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A system having a longitudinal axis, the system comprising:

a drill string sub that is configured to couple to a drill rod of a drill string having an inner surface, wherein the drill string sub comprises an outer surface and an inner surface defining an inner bore; and a plug assembly that is received within the inner bore of the drill string sub and releasably coupled to the drill string sub, wherein, when decoupled from the drill string, the plug assembly is configured to be pumped into the drill string, wherein the plug assembly comprises:

a distal subassembly that defines a receiver that is configured to engage a reverse circulation overshot; and a proximal subassembly that is coupled to the distal subassembly, wherein the proximal subassembly comprises a brake apparatus that is configured to inhibit proximal movement of the plug assembly.

2. The system of claim 1, wherein the brake apparatus comprises:

a brake retainer that defines a central bore, wherein the brake retainer defines a plurality of radial openings positioned in communication with the central bore;

a driving member disposed within the central bore of the brake retainer, wherein the driving member has an outer surface defining at least one wedge surface;

a plurality of braking elements positioned in contact with at least a portion of the outer surface of the driving member, wherein the plurality of braking elements comprise balls or rollers; and a biasing member that is operatively coupled to the driving member, wherein the biasing member is configured to bias the driving member in a proximal direction relative to the longitudinal axis, wherein the at least one wedge surface of the driving member is configured to drive the plurality of braking elements radially outwardly into corresponding radial openings of the brake retainer to engage the inner surface of the drill string.

3. The system of claim 1, wherein the drill string sub defines a first shoulder and a second shoulder that is proximal of the first shoulder, wherein the proximal subassembly of the plug assembly is configured to bias against the first shoulder of the drill sub to limit proximal movement of the proximal subassembly.

4. The system of claim 3, wherein the system further comprises a retainer nut that is coupled to the proximal subassembly of the plug assembly, wherein the retainer nut is positioned proximally of the second shoulder and extends sufficiently radially outwardly to engage the second shoulder to inhibit distal movement of the plug assembly.

5. The system of claim 4, wherein the plug assembly comprises at least one thread, wherein the retainer nut defines at least one thread that is configured to threadedly engage the at least one thread of the plug assembly.

6. The system of claim 1, wherein the proximal subassembly comprises:

a valve ball; and a valve seat that is configured to cooperate with the valve ball to produce a threshold pressure, wherein a fluid pressure in excess of the threshold pressure is configured to drive the valve ball through the valve seat.

7. The system of claim 6, wherein the threshold pressure is indicative of the receptacle of the distal subassembly of the plug assembly engaging the reverse circulation overshot assembly.

8. The system of claim 1, wherein the distal subassembly is slidably coupled to the proximal subassembly relative to the longitudinal axis, wherein the distal subassembly comprises a seal that is configured to bias against the inner surface of the drill string sub to inhibit fluid travel between the distal subassembly and the inner surface of the drill string sub.

9. The system of claim 8, wherein the drill string sub defines at least one through-hole extending between the outer surface and the inner surface, wherein the plug assembly further comprises a biasing element that is configured to bias the distal subassembly distally to a first position, wherein, in the first position, the seal of the distal subassembly is distal of the at least one through-hole of the drill string sub by a first distance.

10. A method comprising:

using a system having:

a longitudinal axis;

a drill string sub that is configured to couple to a drill rod of a drill string having an inner surface, wherein the drill string sub comprises an outer surface and an inner surface defining an inner bore; and a plug assembly that is received within the inner bore of the drill string sub and releasably coupled to the drill string sub, wherein, when decoupled from the drill string, the plug assembly is configured to be pumped into the drill string, wherein the plug assembly comprises:

a distal subassembly that defines a receiver that is configured to engage a reverse circulation overshot; and a proximal subassembly that is coupled to the distal subassembly, wherein the proximal subassembly comprises a brake apparatus that is configured to inhibit proximal movement of the plug assembly, wherein the drill string sub defines a first shoulder and a second shoulder that is proximal of the first shoulder, wherein the proximal subassembly of the plug assembly is configured to bias against the first shoulder of the drill sub to limit proximal movement of the proximal subassembly, wherein the system further comprises a retainer nut that is coupled to the proximal subassembly of the plug assembly, wherein the retainer nut is positioned proximally of the second shoulder and extends sufficiently radially outwardly to engage the second shoulder to inhibit distal movement of the plug assembly, the method further comprising:

coupling the drill string sub to a proximal end of the drill string with the plug assembly within the sub.

11. The method of claim 10, wherein the distal subassembly is slidably coupled to the proximal subassembly relative to the longitudinal axis, wherein the distal subassembly comprises a seal that is configured to bias against the inner surface of the drill string sub to inhibit fluid travel between the distal subassembly and the inner surface of the drill string sub.

12. The method of claim 11, wherein the drill string sub defines at least one through-hole extending between the outer surface and the inner surface, wherein the plug assembly further comprises a biasing element that is configured to bias the distal subassembly distally to a first position, wherein, in the first position, the seal of the distal subassembly is distal of the at least one through-hole of the drill string sub by a first distance.

13. The method of claim 12, wherein in response to a distal force that surpasses a threshold proximal force provided by the biasing element, the distal subassembly is configured to travel proximally until the seal of the distal subassembly is proximal of the at least one through-hole of the drill string sub, the method further comprising:

causing a reverse circulation overshot to move proximally in the drill string until the distal subassembly moves the first distance from the first position; and detecting a change in fluid pressure in the drill string corresponding to fluid exiting the at least one through-hole.

14. The method of claim 10, further comprising:

pumping the plug assembly distally along the drill string until the plug assembly engages the reverse circulation overshot.

15. The method of claim 14, further comprising:

decoupling the retainer nut from the proximal subassembly of the plug assembly prior to pumping the plug assembly distally along the drill string.

16. The method of claim 10, further comprising:

detecting, based on a fluid pressure change, engagement of the plug assembly with the reverse circulation overshot.

17. The method of claim 10, further comprising:

retracting the driving member proximally relative to the brake retainer; and moving the plug assembly proximally in the drill string until the plug assembly engages the first shoulder.

18. A method comprising:

releasing a plug assembly from a drill string sub that is coupled to a drill string, wherein the plug assembly comprises a brake apparatus that is configured to inhibit proximal movement of the plug assembly; and pumping the plug assembly distally until the plug assembly engages a reverse circulation overshot.

* * * * *